US007594659B2

(12) United States Patent
Nishimura

(10) Patent No.: US 7,594,659 B2
(45) Date of Patent: Sep. 29, 2009

(54) PAPER CONVEYING/BRANCHING DEVICE

(75) Inventor: Toshinori Nishimura, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 324 days.

(21) Appl. No.: 11/410,016

(22) Filed: Apr. 25, 2006

(65) Prior Publication Data

US 2006/0245788 A1 Nov. 2, 2006

(30) Foreign Application Priority Data

Apr. 28, 2005 (JP) ..... 2005-132597

(51) Int. Cl.
*B65H 39/10* (2006.01)

(52) U.S. Cl. ..... 271/303

(58) Field of Classification Search ..... 271/303
See application file for complete search history.

(56) References Cited

U.S. PATENT DOCUMENTS 4,228,996 A * 10/1980 Wilcox, Jr. ..... 271/297
4,486,015 A * 12/1984 Takahashi ..... 271/305
6,196,464 B1 * 3/2001 Patterson et al. ..... 235/477
6,547,241 B2 * 4/2003 Yoshida et al. ..... 271/303
6,926,272 B2 * 8/2005 Carter et al. ..... 271/258.01
6,981,636 B2 * 1/2006 Gallo-Hendrikx ..... 235/379
6,988,729 B2 * 1/2006 Tamura et al. ..... 271/303
2003/0234487 A1 * 12/2003 Tamura et al. ..... 271/303

FOREIGN PATENT DOCUMENTS

JP 2004-331387 11/2004

* cited by examiner

*Primary Examiner*—Patrick H Mackey
*Assistant Examiner*—Michael C McCullough
(74) *Attorney, Agent, or Firm*—Smith, Gambrell & Russell, LLP

(57) ABSTRACT

A paper conveying/branching device comprising a main conveyer passage, a first branched conveyer passage, a second branched conveyer passage, a conveyer passage change-over guide member, a solenoid and a controller. When the displacing member of the solenoid is displaced to the first operation position from the second operation position, the conveyer passage change-over guide member is rotated from the second position to the first position by its own weight or by a spring force, so that the upstream side in the direction of conveying the paper is lowered with respect to the support shaft. In a state where the conveyer passage change-over guide member is brought to the second position, the controller so operates the solenoid that the displacing member is displaced to the first operation position from the second operation position after the leading end of the paper has passed through, or while the leading end of the paper is passing through, the conveyer passage change-over guide member.

4 Claims, 8 Drawing Sheets

PAPER CONVEYING/BRANCHING DEVICE

BACKGROUND OF THE INVENTION

1. Field of the Invention

The present invention relates to a paper conveying/branching device mounted on an image-forming machine such as an electrostatic photographic copier, a printer or a facsimile. More specifically, the invention relates to a paper conveying/branching device comprising a main conveyer passage, a first branched conveyer passage branched from the downstream end of the main conveyer passage and for discharging the paper in a face-down manner, a second branched conveyer passage branched from the downstream end and for discharging the paper in a face-up manner, and a conveyer passage change-over guide member disposed at the downstream end.

2. Description of the Related Art

A paper conveying/branching device mounted on an image-forming machine comprises representatively a main conveyer passage that extends nearly in a horizontal transverse direction, a first branched conveyer passage branched from the downstream end of the main conveyer passage and for discharging the paper in a face-down manner, a second branched conveyer passage branched from the down stream end and for discharging the paper in a face-up manner, and a conveyer passage change-over guide member disposed at the downstream end. The conveyer passage change-over guide member is changed by a solenoid over to a first position for closing the second branched conveyer passage and for communicating the main conveyer passage with the first branched conveyer passage, and to a second position for closing the first branched conveyer passage and for communicating the main conveyer passage with the second branched conveyer passage (see JP-A-2004-331387). A fixing device is arranged at a position upstream of the downstream end of the main conveyer passage.

In the above paper conveying/branching device, the first branched conveyer passage for discharging the paper in a face-down manner is bent upward from the downstream end of the main conveyer passage at a sharp angle which is close to 90 degrees, and it is probable that the paper is curled. The second branched conveyer passage for discharging the paper in a face-up manner is extending on an extension of the main conveyer passage that extends nearly in a horizontal transverse direction, and it is not probable that the paper is curled. Depending upon the layout of the image-forming machine, however, the second branched conveyer passage, too, must be curved downward from the downstream end of the main conveyer passage at a relatively large angle. In this case, it becomes probable that the paper may be curled depending upon its kind. It is therefore desired to decrease, as much as possible, the probability of curling of the paper conveyed through the second branched conveyer passage even in case the second branched conveyer passage is set to be curved relatively greatly due to the layout of the image-forming machine. In order to realize the image-forming machine in a compact size, further, the first branched conveyer passage is, usually, greatly curved though it is desired to decrease, as much as possible, the probability of curling of the paper conveyed through the first branched conveyer passage.

SUMMARY OF THE INVENTION

An object of the present invention is to provide a novel paper conveying/branching device which is capable of decreasing the probability of curling of the paper conveyed through the second branched conveyer passage which is branched from the downstream end of the main conveyer passage for discharging the paper in a face-up manner.

Another object of the present invention is to provide a novel paper conveying/branching device which is capable of decreasing the probability of curling of the paper conveyed through the first branched conveyer passage which is branched from the downstream end of the main conveyer passage for discharging the paper in a face-down manner.

According to one aspect of the present invention, there is provided a paper conveying/branching device comprising:

a main conveyer passage;

a first branched conveyer passage branched from the downstream end of the main conveyer passage for discharging the paper in a face-down manner;

a second branched conveyer passage branched from the downstream end for discharging the paper in a face-up manner;

a conveyer passage change-over guide member disposed at the downstream end so as to rotate about a support shaft;

an actuator having a displacing member capable of being displaced between a first operation position for changing over the conveyer passage change-over guide member to a first position for closing the second branched conveyer passage and for communicating the main conveyer passage with the first branched conveyer passage and to a second operation position for changing over to a second position for closing the first branched conveyer passage and for communicating the main conveyer passage with the second branched conveyer passage; and a controller for controlling the operation of the actuator;

wherein, when the conveyer passage change-over guide member is changed over to the second position, the paper is so guided as to move along the lower surface of the conveyer passage change-over guide member;

when the displacing member is displaced to the first operation position from the second operation position, the conveyer passage change-over guide member is rotated from the second position to the first position by its own weight or by a spring force of spring means, so that the upstream side in the direction of conveying the paper is lowered with respect to the support shaft; and in a state where the conveyer passage change-over guide member is brought to the second position, the controller so operates the actuator that the displacing member is displaced to the first operation position from the second operation position after the leading end of the paper has passed through, or while the leading end of the paper is passing through, the conveyer passage change-over guide member.

It is desired that the conveyer passage change-over guide member has a to-be-engaged portion disposed on the upstream of the support shaft in the direction of conveying the paper and is extending outward in the axial direction from the one side thereof in the axial direction, the actuator comprises a solenoid having a moving core that displaces up and down, the displacing member is mounted on the moving core integrally therewith and has an engaging portion positioned on the lower side of the to-be-engaged portion of the conveyer passage change-over guide member, and when the actuator is turned off in a state where the conveyer passage change-over guide member is brought to the second position, the moving core is lowered, the displacing member is displaced to the first operation position from the second operation position, the engaging portion of the displacing member is lowered down in a direction to separate away from the to-be-engaged portion of the conveyer passage change-over guide member, and the conveyer passage change-over guide member is rotated to the first position from the second position due to its own weight or due to spring means.

According to another aspect of the present invention, there is provided a paper conveying/branching device comprising:

a main conveyer passage;

a first branched conveyer passage branched from the downstream end of the main conveyer passage for discharging the paper in a face-down manner;

a second branched conveyer passage branched from the downstream end for discharging the paper in a face-up manner;

a conveyer passage change-over guide member disposed at the downstream end so as to rotate about a support shaft;

an actuator having a displacing member capable of being displaced between a first operation position for changing over the conveyer passage change-over guide member to a first position for closing the second branched conveyer passage and for communicating the main conveyer passage with the first branched conveyer passage and a second operation position for changing over to a second position for closing the first branched conveyer passage and for communicating the main conveyer passage with the second branched conveyer passage; and a controller for controlling the operation of the actuator;

wherein, when the conveyer passage change-over guide member is changed over to the first position, the paper is so guided as to move along the upper surface of the conveyer passage change-over guide member;

when the displacing member is displaced to the second operation position from the first operation position, the conveyer passage change-over guide member is rotated from the first position to the second position by its own weight or by a spring force of spring means, so that the upstream side in the direction of conveying the paper is raised with respect to the support shaft; and in a state where the conveyer passage change-over guide member is brought to the first position, the controller so operates the actuator that the displacing member is displaced to the second operation position from the first operation position after the leading end of the paper has passed through, or while the leading end of the paper is passing through, the conveyer passage change-over guide member.

It is desired that the conveyer passage change-over guide member has a to-be-engaged portion disposed on the downstream of the support shaft in the direction of conveying the paper and is extending outward in the axial direction from the one side thereof in the axial direction, the actuator comprises a solenoid having a moving core that displaces up and down, the displacing member is mounted on the moving core integrally therewith and has an engaging portion positioned on the lower side of the to-be-engaged portion of the conveyer passage change-over guide member, and when the actuator is turned off in a state where the conveyer passage change-over guide member is brought to the first position, the moving core is lowered, the displacing member is displaced to the second operation position from the first operation position, the engaging portion of the displacing member is lowered down in a direction to separate away from the to-be-engaged portion of the conveyer passage change-over guide member, and the conveyer passage change-over guide member is rotated to the second position from the first position due to its own weight or due to spring means.

DETAILED DESCRIPTION OF THE PREFERRED EMBODIMENTS

Figure 1:
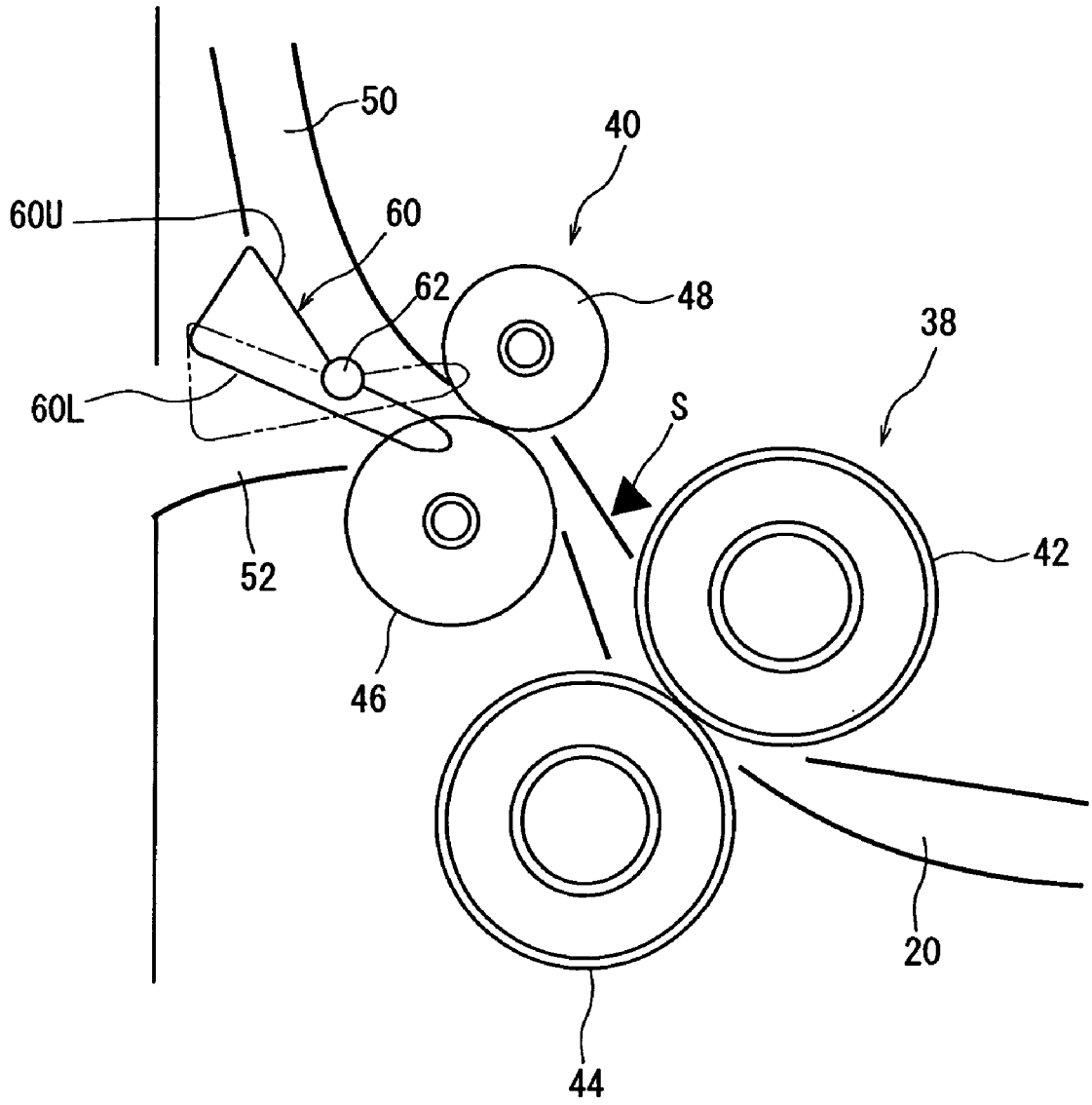
FIG. 1 is a schematic view of constitution of a conveying/branching passage to which a paper conveying/branching device of the present invention is applied.

Preferred embodiments of the paper conveying/branching device constituted according to the present invention will now be described in detail with reference to the accompanying drawings. In FIGS. 1 to 11, the portions which are substantially the same are denoted by the same reference numerals.

Figure 11:
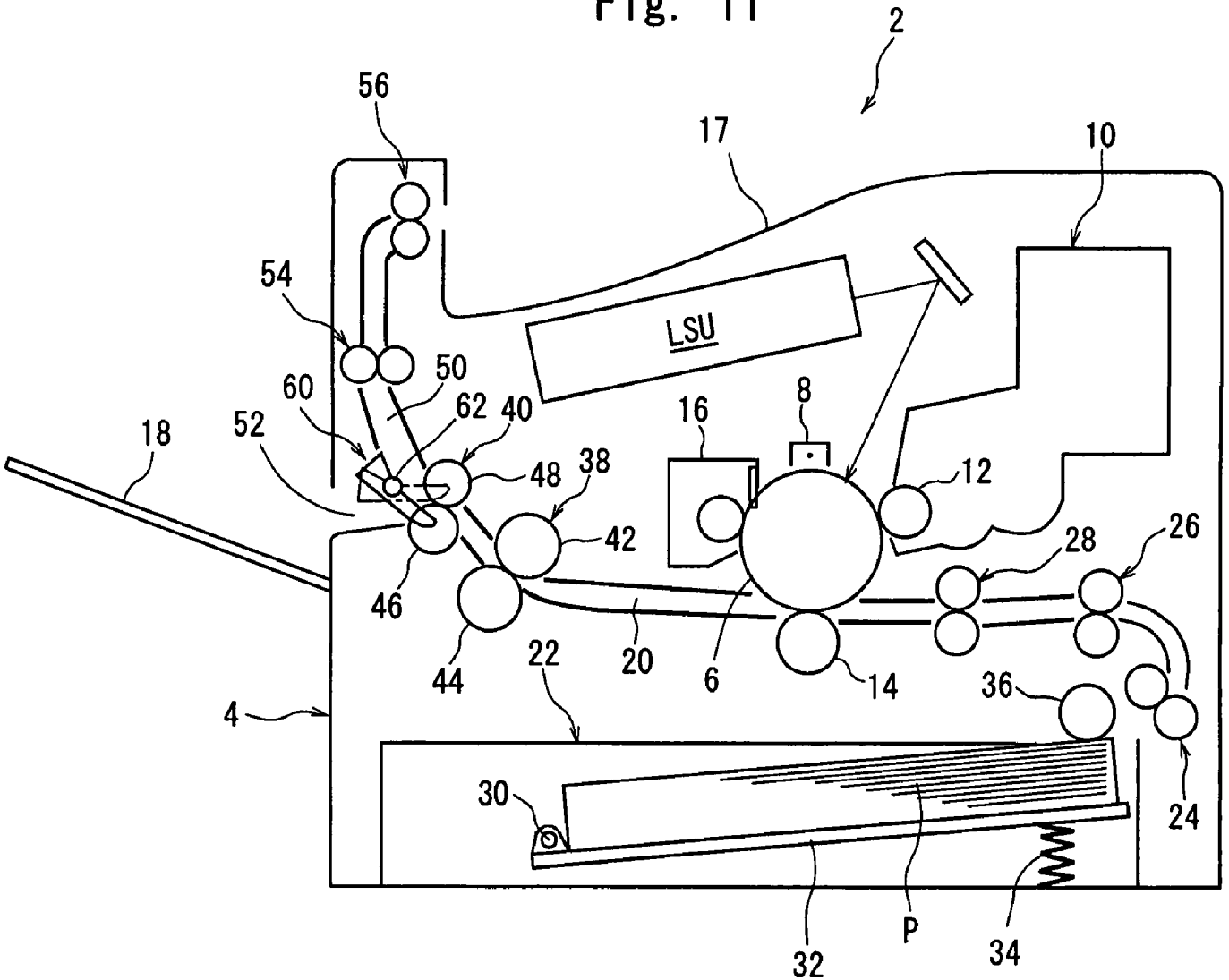
FIG. 11 is a schematic view of constitution illustrating an embodiment of a laser printer to which the paper conveying/branching device of the present invention is applied.

First, briefly described below with reference to FIG. 11 is the whole constitution of a laser printer which is an image-forming machine to which the paper conveying/branching device of the present invention is applied.

Referring to FIG. 11, reference numeral 2 denotes a laser printer (hereinafter simply referred to as "printer") which is an image-forming machine. The printer 2 includes a printer body 4 which is a body of the image-forming machine of nearly a rectangular parallelepiped shape. A photosensitive material drum 6 is arranged nearly at the central portion in the printer body 4. The photosensitive material drum 6 is surrounded by image-forming elements such as a main charger 8, a developing roller 12 provided in a developing unit 10, a transfer roller 14, a cleaning unit 16, and a charge-removing unit that is not shown. A laser scanning unit LSU is arranged at an upper position in the printer body 4 for converting the image data that is input into a laser beam, and for projecting the laser beam onto the surface of the photosensitive material drum 6. The laser scanning unit LSU, too, is one of the image-forming elements. A paper discharge tray 17 is arranged at an upper end of the printer body 4, and another paper discharge tray 18 is arranged on one side of the printer body 4 (left side in FIG. 11) being protruded upward and tilted. The paper discharge tray 18 can be folded so as to extend along the one side of the printer body 4.

A main conveyer passage 20 for conveying a paper is arranged nearly at the central portion in the printer body 4 in the up-and-down direction, and a paper-feed cassette 22 is detachably arranged at a lower end thereof. The main conveyer passage 20 extends nearly horizontally passing through between the photosensitive material drum 6 and the transfer roller 14 in the tangential direction thereof. The upstream end region of the main conveyer passage 20 is inverted downward and is connected to the paper-feed cassette 22. On the upstream of the photosensitive material drum 6 in the main conveyer passage 20, there are arranged separation rollers 24, conveyer rollers 26 and resist rollers 28 along the main conveyer passage 20 from the upstream toward the downstream in this order. In the paper-feed cassette 22, there are arranged a bottom plate 32 which is a paper-placing plate supported at its one end to rotate about a shaft 30, and a compression coil spring 34 for pushing up the other end of the bottom plate 32. The upper surface at the leading end of the paper P stacked and contained on the bottom plate 32 is press-contacted to a pickup roller 36 arranged in the printer body 4.

Referring to FIG. 11 as well as FIG. 1, a fixing unit 38 and a conveyer roller 40 are arranged in the main conveyer passage 20 on the downstream of the photosensitive material drum 6. The fixing unit 38 includes a heating roller 42 and a pressing roller 44. The conveyer roller 40 arranged downstream of the fixing unit 38 includes a drive roller 46 and a driven roller 48. The main conveyer passage 20 is connected at its downstream end (downstream end just downstream of the conveyer roller 40) to two branched conveyer passages. The two branched conveyer passages include a first branched conveyer passage 50 branched from the downstream end of the main conveyer passage 20 and for discharging the paper P in a face-down manner onto the paper discharge tray 17, and a second branched conveyer passage 52 branched from the downstream end and for discharging the paper in a face-up manner onto the paper discharge tray 18. In the first branched conveyer passage 50, there are arranged conveyer rollers 54 and discharge rollers 56 from the upstream toward the downstream in this order. At the downstream end of the main conveyer passage 20, a conveyer passage change-over guide member 60 is arranged so as to rotate about a support shaft 62.

The main conveyer passage 20 extends upward and tilted from the fixing unit 38 toward the conveyer roller 40. The first branched conveyer passage 50 exists just on the downstream of the conveyer roller 40, is branching from the downstream end of the main conveyer passage 20, extends upward and tilted from the downstream end nearly at an angle close to a vertical line, further extends nearly vertically on the inner side of one side of the printer body 4 along the one side thereof, and is curved upward and tilted toward the discharge rollers 56. Further, the second branched conveyer passage 52 is branched from the downstream end of the main conveyer passage 20, and extends downward and tilted from the downstream end toward the paper discharge tray 18.

As will be described later in detail, the conveyer passage change-over guide member 60 is changed by the solenoid SOL which is the actuator over to the first position (position represented by the solid line in FIG. 1) for closing the second branched conveyer passage 52 and for communicating the main conveyer passage 20 with the first branched conveyer passage 50 and to the second position (position represented by the two-dot chain line in FIG. 1) for closing the first branched conveyer passage 50 and for communicating the main conveyer passage 20 with the second branched conveyer passage 52.

As is well known, while the paper P fed from the paper-feed cassette 22 is being conveyed through the main conveyer passage 20, the toner image is recorded onto one surface (upper surface) by the image-forming element and is fixed by the fixing unit 38. When the face-down discharge mode has been set and the conveyer passage change-over guide member 60 has been changed over to the first position, the paper P having the toner image fixed thereon is conveyed by the conveyer roller 40 into the first branched conveyer passage 50, and is discharged by the conveyer rollers 54 and by the discharge rollers 44 in the face-down manner onto the paper discharge tray 17. When the face-up discharge mode has been set and the conveyer passage change-over guide member 60 has been changed over to the second position, on the other hand, the paper P having the toner image fixed thereon is discharged by the conveyer roller 40 in the face-up manner onto the paper discharge tray 18 through the second branched conveyer passage 52.

Described below next is an embodiment of the paper conveying/branching device of the present invention. Referring to FIGS. 1 to 4, the paper conveying/branching device includes the main conveyer passage 20, the first branched conveyer passage 50, the second branched conveyer passage 52, the conveyer passage change-over guide member 60, the solenoid SOL which is the actuator for changing over the conveyer passage change-over guide member 60, and the controller 100 for controlling the operation of the solenoid SOL.

The conveyer passage change-over guide member 60 made of a suitable synthetic resin as a unitary form includes a plurality of guide plate portions having nearly a triangular shape in cross section at right angles with the axial direction (direction perpendicular to the surface of the paper in FIG. 1) and arranged maintaining a distance in the axial direction, a coupling portion extending among the guide plate portions in the axial direction to couple the guide plate portions integrally together, and support shafts 62 extending outward in the axial direction from both ends in the axial direction. The support shafts 62 are positioned on a common axis. When the conveyer passage change-over guide member 60 is viewed in the axial direction, the guide plate portions are formed by a short side and two long sides that appear to be overlapped in the axial direction, and the support shafts 62 are arranged in the intermediate portions of the two long sides in a direction in which they extend. The conveyer passage change-over guide member 60 has the support shafts 62 supported among the support walls which are not shown so as to rotate. In a state where the conveyer passage change-over guide member 60 is supported among the support walls, the short side of each guide plate portion is positioned on the downstream side in the direction of conveying the paper P. The conveyer passage change-over guide member 60 has a to-be-engaged pin 64 which is a to-be-engaged portion arranged on the upstream of the support shafts 62 in the direction of conveying the paper P and extending outward in the axial direction from the one side in the axial direction.

The solenoid SOL is arranged on one support wall that is not shown, disposed at an upper position on one side of the conveyer passage change-over guide member 60 in the axial direction, and includes a moving core 66 that displaces up and down. A displacing member 70 is integrally attached to the lower end of the moving core 66. The displacing member 70 made of a suitable synthetic resin as a unitary form includes a plate-like main body 72 extending downward from the lower end, and a rectangular plate-like engaging portion 74 extending at the lower end of the main body 72 at right angles from the one surface of the main body 72. The engaging portion 74 is positioned on the lower side of the to-be-engaged pin 64 of the conveyer passage change-over guide member 60.

The displacing member 70 of the solenoid SOL is capable of being displaced between the first operation position (position shown in FIG. 2) for changing over the conveyer passage change-over guide member 60 to the first position (position represented by a solid line in FIG. 1 and position shown in FIG. 2) for closing the second branched conveyer passage 52 and for communicating the main conveyer passage 20 with the first branched conveyer passage 50 and the second operation position (position shown in FIG. 3) for changing over to the second position (position represented by the two-dot chain line in FIG. 1 and position shown in FIG. 3) for closing the first branched conveyer passage 50 and for communicating the main conveyer passage 20 with the second branched conveyer passage 52.

Figure 2:
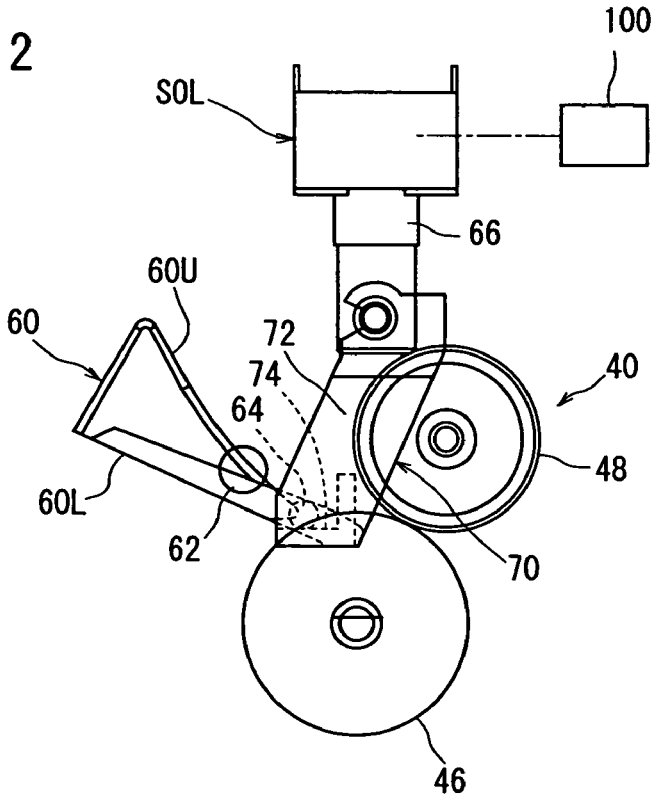
FIG. 2 is a view of constitution illustrating major portions of an embodiment of the paper conveying/branching device of the present invention.

That is, in a state where the solenoid SOL is turned off (not excited) as shown in FIG. 2, the moving core 66 and the displacing member 70 are lowered by a maximum stroke due to a spring (not shown) arranged in the solenoid SOL. The displacing member 70 is brought to the first operation position. The conveyer passage change-over guide member 60 is so rotated by its own weight or by a spring force of spring means that the upstream side in the direction of conveying the paper P (right side in FIG. 2) is lowered with respect to the support shaft 62. The rotation is limited as the to-be-engaged pin 64 of the conveyer passage change-over guide member 60 is brought into contact with the upper surface of the engaging portion 74 of the displacing member 70 which is at the first operation position, or the rotation is limited by any other rotation-limiting means, whereby the to-be-engaged pin 64 is positioned close to the upper surface of the engaging member 74, and the conveyer passage change-over guide member 60 is brought to the first position. The paper P conveyed through the fixing unit 38 and the conveyer roller 40 is guided into the first branched conveyer passage 50 along the upper surface 60U defined by the upper one side of the two long sides of the guide plate portions of the conveyer passage change-over guide member 60.

When the solenoid SOL is turned on (excited) in the state shown in FIG. 2, the moving core 66 is attracted and is raised together with the displacing member 70 by the same stroke overcoming the spring force of a spring (not shown) arranged in the solenoid SOL. The displacing member 70 is positioned being raised to the second operation position from the first operation position. The to-be-engaged pin 64 of the conveyer passage change-over guide member 60 is raised by the same stroke by the upper surface of the engaging portion 74 of the displacing member 70 that is raised from the first operation position to the second operation position. Therefore, the conveyer passage change-over guide member 60 is so rotated overcoming its own weight or the spring force of the spring means that the upstream side in the direction of conveying the paper P (right side in FIG. 2) is raised with respect to the support shafts 62. The conveyer passage change-over guide member 60 is positioned being rotated from the first position to the second position (see FIG. 3). The paper P conveyed through the fixing unit 38 and the conveyer roller 40 is guided into the second branched conveyer passage 52 along the lower surface 60L defined by the lower one side of the two long sides of the guide plate portions of the conveyer passage change-over guide member 60.

The above other rotation-limiting means of the to-be-engaged pin 64 of the conveyer passage change-over guide member 60 can be established by inserting the to-be-engaged pin 64 in an elongated hole or in a notch (not shown) perforated in the side wall which is not shown. Further, the conveyer passage change-over guide member 60 is so rotated by its own weight or by the spring force of the spring means that the upstream side in the direction of conveying the paper P (right side in FIG. 2) is lowered with respect to the support shafts 62. When the spring means is to be used, a torsion coil spring may be arranged on one of the support shafts 62. The torsion coil spring is anchored at its one end to the conveyer passage change-over guide member 60 and is anchored at its other end to the one support wall that is not shown. According to another embodiment, the spring means may be constituted by a tension coil spring or a compression coil spring arranged between the conveyer passage change-over guide member 60 and a stationary frame (not shown) arranged in the printer body 4. When not limited by the external force, the conveyer passage change-over guide member 60 is urged to be rotated up to the first position (position represented by the solid line in FIG. 1 or position shown in FIG. 2) at all times due to its own weight or the spring force of the spring means. In FIG. 1, symbol S denotes a paper sensor provided in the main conveyer passage 20 between the fixing unit 38 and the conveyer roller 40.

Figure 3:
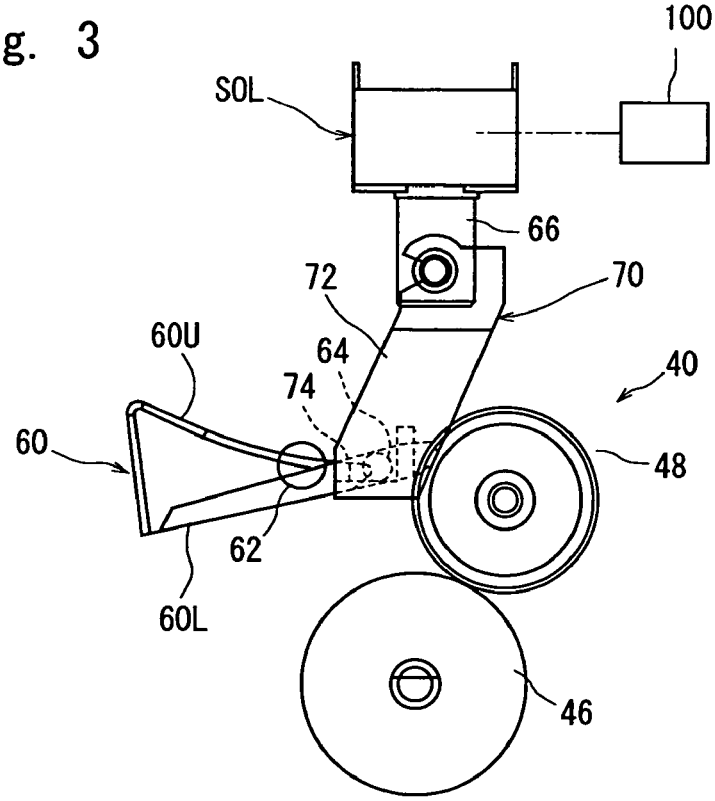
FIG. 3 is a view of constitution illustrating another state of operation of the paper conveying/branching device shown in FIG. 2.
Figure 4:
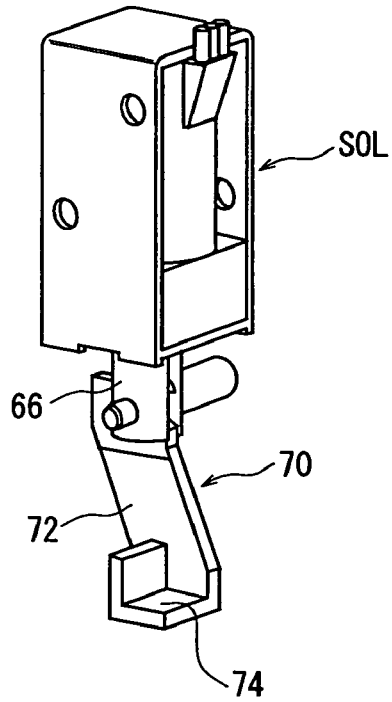
FIG. 4 is a perspective view of a solenoid provided for the paper conveying/branching device shown in FIGS. 2 and 3.

The controller 100 is constituted by a microcomputer and includes a central processing unit (CPU) that executes arithmetic processings according to a control program, a ROM for storing the control program, a read-write RAM for storing the results of arithmetic processings, a timer, a counter, an input interface and an output interface. The thus constituted controller 100 receives detection signals from the paper sensor S and other switches or detectors through the input interface, and produces, through the output interface, control signals to the solenoid SOL. In this embodiment, the controller 100 also works as a controller (not shown) for the printer 2. When the face-down discharge mode has been set, the controller 100 further turns the solenoid SOL off to bring the conveyer passage change-over guide member 60 to the first position (FIG. 2). When the face-up discharge mode has been set, the solenoid SOL is turned on to bring the conveyer passage change-over guide member 60 to the second position (FIG. 3). The face-up discharge mode is set by, for example, operating the keyboard arranged on the printer body 4. The face-down discharge mode may have been programmed in advance in a manner that the face-down discharge mode is maintained unless the face-up discharge mode is set.

Figure 5:
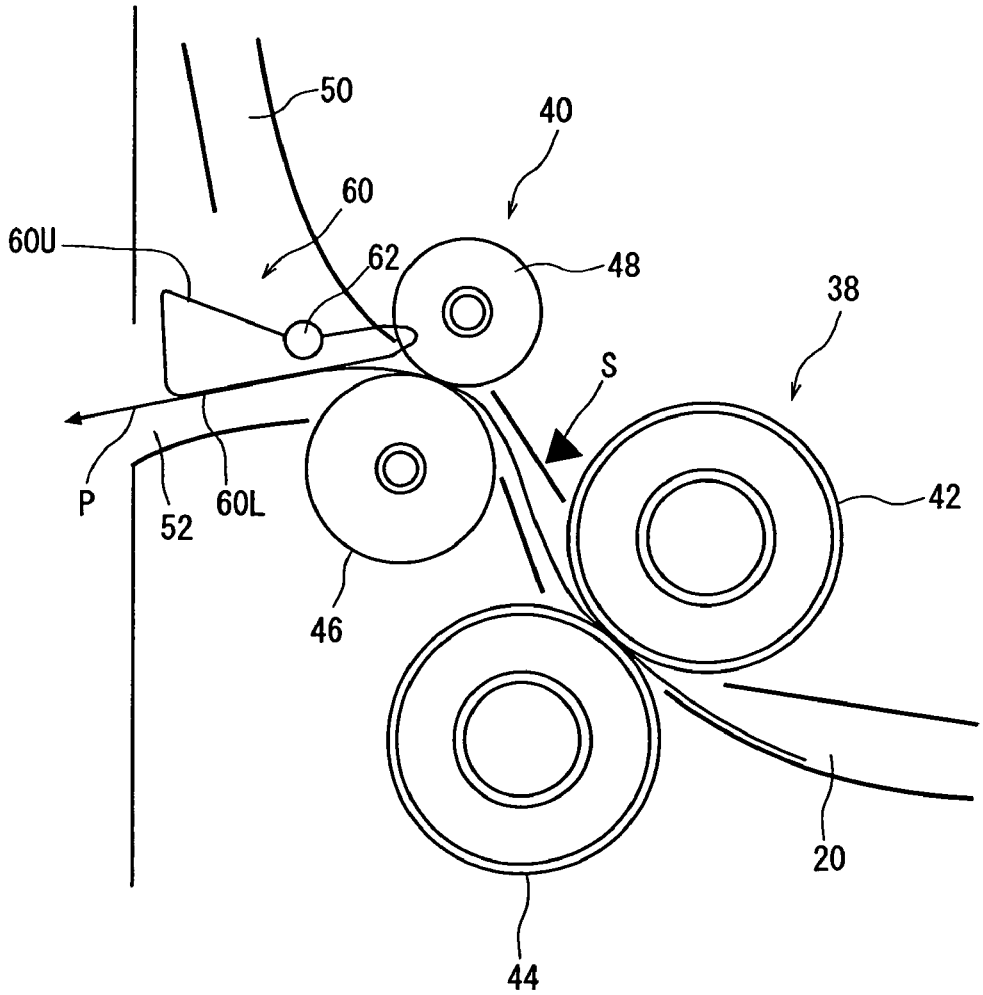
FIG. 5 is a view schematically illustrating a state where the paper is passing through the conveying/branching passage while the conveyer passage change-over guide member is positioned at a second position (second position shown in FIG. 3) represented by a two-dot chain line in FIG. 1 in the conveying/branching passage shown in FIG. 1.

Referring to FIGS. 2, 3 and 5, in a state where the conveyer passage change-over guide member 60 is brought to the second position (FIGS. 3 and 5), the controller 100 so operates the solenoid SOL that the displacing member 70 is displaced to the first operation position (FIG. 2) from the second operation position (FIG. 3) after the leading end of the paper P has passed through, or while the leading end of the paper P is passing through, the conveyer passage change-over guide member 60. Namely, in the state where the conveyer passage change-over guide member 60 is brought to the second position (FIG. 3), the controller 100 judges whether the leading end of the paper P has passed through, or is passing through, the conveyer passage change-over guide member 60 after the passage of a predetermined period of time from when the leading end of the paper P was detected by the paper sensor S, and turns the solenoid SOL off. The moving core 66 is lowered, and the displacing member 70 is displaced from the second operation position (FIG. 3) to the first operation position (FIG. 2). The engaging portion 74 of the displacing member 70 is lowered down in a direction to separate away from the to-be-engaged pin 64 of the conveyer passage change-over guide member 60, and the conveyer passage change-over guide member 60 is rotated clockwise in FIGS. 3 and 5 to the first position (FIG. 2) from the second position (FIGS. 3 and 5) due to its own weight or due to spring means, so that the upstream side in the direction of conveying the paper P (right side in FIG. 3) is lowered with respect to the support shafts 62. Here, however, the paper P is passing through the second branched conveyer passage 52 along the lower surface 60L of the conveyer passage change-over guide member 60. Therefore, the conveyer passage change-over guide member 60 is limited by the paper P from rotating. Accordingly, the conveyer passage change-over guide member 60 is positioned in a state that is rotated by a small amount (see FIG. 6).

Figure 6:
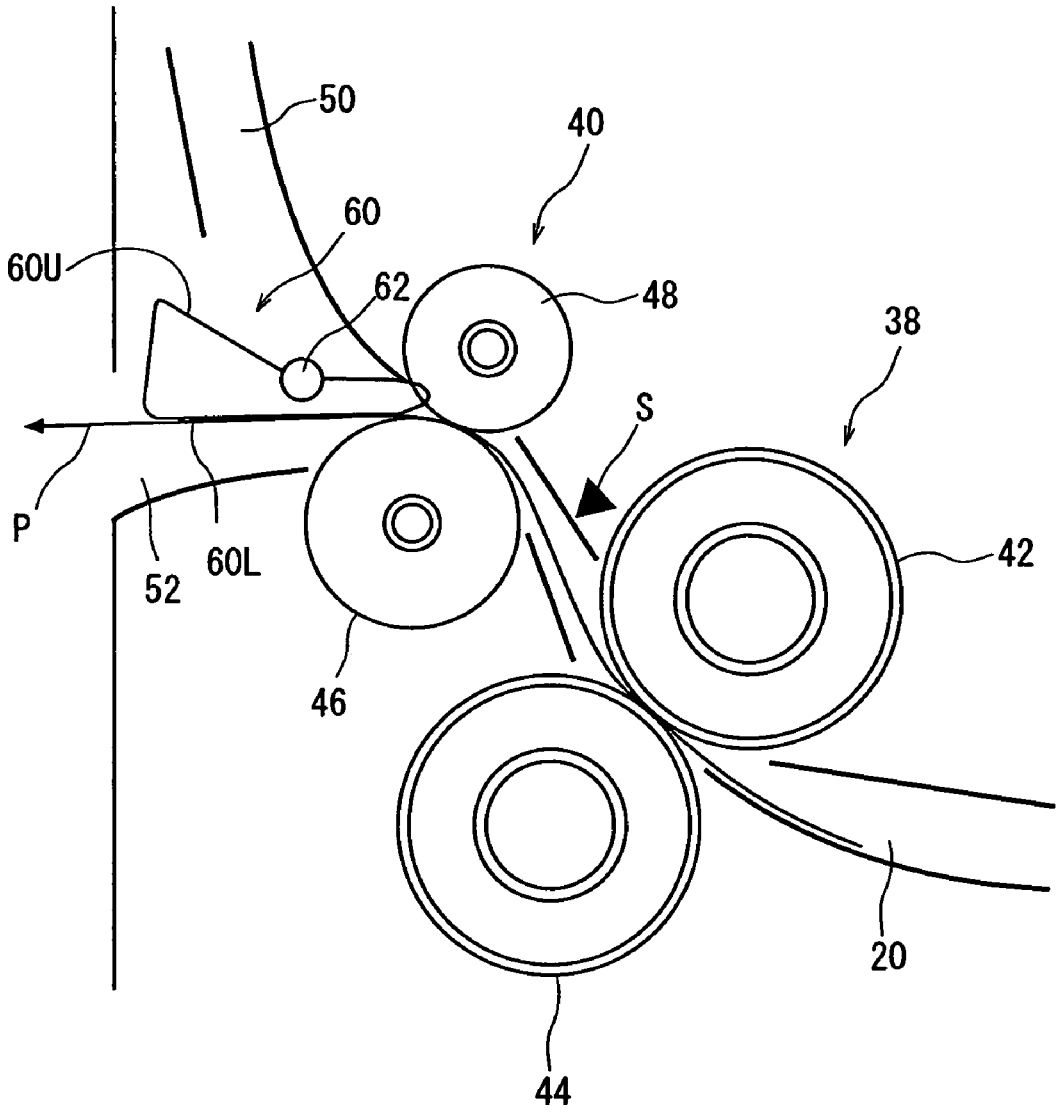
FIG. 6 is a view schematically illustrating a state of the conveyer passage change-over guide member and a state where the paper is passing through the conveying/branching passage when the solenoid is brought to the first operation position shown in FIG. 2 in the state shown in FIG. 5.

As will be easily understood from the comparison of FIG. 5 with FIG. 6, the tilt of the lower surface 60L of the conveyer passage change-over guide member 60 is relaxed by a small amount when the conveyer passage change-over guide member 60 is so rotated by a small amount that the upstream side in the direction of conveyance (right side in FIG. 5) is lowered in a state where the paper P is passing through the second branched conveyer passage 52 along the lower surface 60L of the conveyer passage change-over guide member 60 which is at the second position (FIG. 5). Therefore, the paper P is curved mildly (curvature becomes small). This decreases the probability of curling of the paper P that is conveyed through the second branched conveyer passage 52 which is branched from the downstream end of the main conveyer passage 20 for discharging the paper P in a face-up manner.

As described above, the controller 100 judges whether the leading end of the paper P has passed through, or is passing through, the conveyer passage change-over guide member 60 after the passage of a predetermined period of time from when the leading end of the paper P was detected by the paper sensor S, and turns the solenoid SOL off. This timing may be set by taking into consideration the conditions that do not interrupt the paper P from being smoothly conveyed.

Next, another embodiment of the paper conveying/branching device of the present invention will be described with reference to FIGS. 7 to 10. The to-be-engaged pin 64 which is the to-be-engaged portion of the conveyer passage change-over guide member 60 is disposed on the downstream of the support shafts 62 in the direction of conveying the paper P, and is protruding outward in the axial direction from the one side thereof in the axial direction. In the above-mentioned embodiment, the to-be-engaged pin 64 was disposed on the upstream of the support shafts 62 in the direction of conveying the paper P. In this another embodiment, therefore, the disposition of the to-be-engaged pin 64 is different from that of the above embodiment. Constitution of the solenoid SOL inclusive of the displacing member 70 and relative positional relationship of the engaging portion 74 to the to-be-engaged pin 64, are substantially the same as those of the above embodiment and are not described here again.

The displacing member 70 of the solenoid SOL is capable of being displaced between the first operation position (position shown in FIG. 7) for changing the conveyer passage change-over guide member 60 over to the first position (position represented by the solid line in FIG. 1 and position shown in FIG. 7) for closing the second branched conveyer passage 52 and for communicating the main conveyer passage 20 with the first branched conveyer passage 50 and the second operation position (position shown in FIG. 8) for changing over to the second position (position represented by the two-dot chain line in FIG. 1 and position shown in FIG. 8) for closing the first branched conveyer passage 50 and for communicating the main conveyer passage 20 with the second branched conveyer passage 52.

Figure 8:
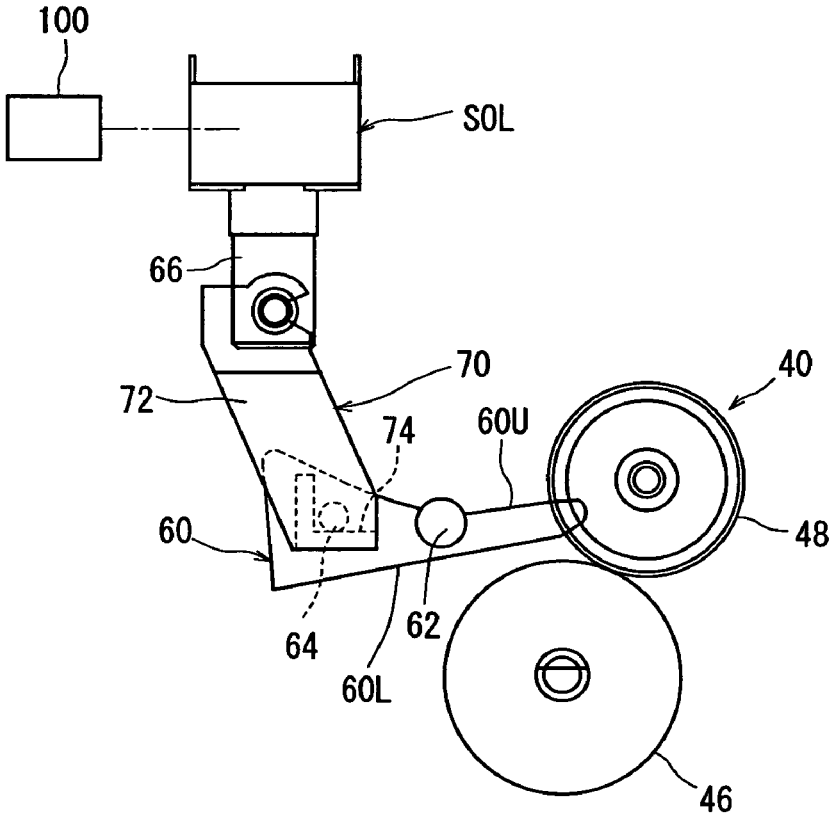
FIG. 8 is a view of constitution illustrating a further embodiment of the paper conveying/branching device shown in FIG. 7.

That is, in a state where the solenoid SOL is turned off (not excited) as shown in FIG. 8, the moving core 66 and the displacing member 70 are lowered by a maximum stroke due to the spring (not shown) arranged in the solenoid SOL. The displacing member 70 is brought to the second operation position. The conveyer passage change-over guide member 60 is so rotated by its own weight or by the spring force of spring means (which may have substantially the same constitution as the one described above though the urging direction is not the same) that the upstream side in the direction of conveying the paper P (right side in FIG. 8) is raised with respect to the support shafts 62. The rotation is limited as the to-be-engaged pin 64 of the conveyer passage change-over guide member 60 is brought into contact with the upper surface of the engaging portion 74 of the displacing member 70 which is at the second operation position, or the rotation is limited by any other rotation-limiting means, whereby the to-be-engaged pin 64 is positioned close to the upper surface of the engaging member 74, and the conveyer passage change-over guide member 60 is brought to the second position. The paper P conveyed through the fixing unit 38 and the conveyer roller 40 is guided into the second branched conveyer passage 52 along the lower surface 60L defined by the lower one side of the two long sides of the guide plate portions of the conveyer passage change-over guide member 60.

When the solenoid SOL is turned on (excited) in the state shown in FIG. 8, the moving core 66 is attracted and is raised together with the displacing member 70 by the same stroke overcoming the spring force of the spring (not shown) arranged in the solenoid SOL. The displacing member 70 is positioned being raised to the first operation position from the second operation position. The to-be-engaged pin 64 of the conveyer passage change-over guide member 60 is raised by the same stroke by the upper surface of the engaging portion 74 of the displacing member 70 that is raised from the second operation position to the first operation position. Therefore, the conveyer passage change-over guide member 60 is so rotated overcoming its own weight or the spring force of the spring means that the upstream side in the direction of conveying the paper P (right side in FIG. 8) is lowered with respect to the support shafts 62. The conveyer passage change-over guide member 60 is positioned being rotated from the second position to the first position (see FIG. 7). The paper P conveyed through the fixing unit 38 and the conveyer roller 40 is guided into the first branched conveyer passage 50 along the upper surface 60U defined by the upper one side of the two long sides of the guide plate portions of the conveyer passage change-over guide member 60.

Figure 7:
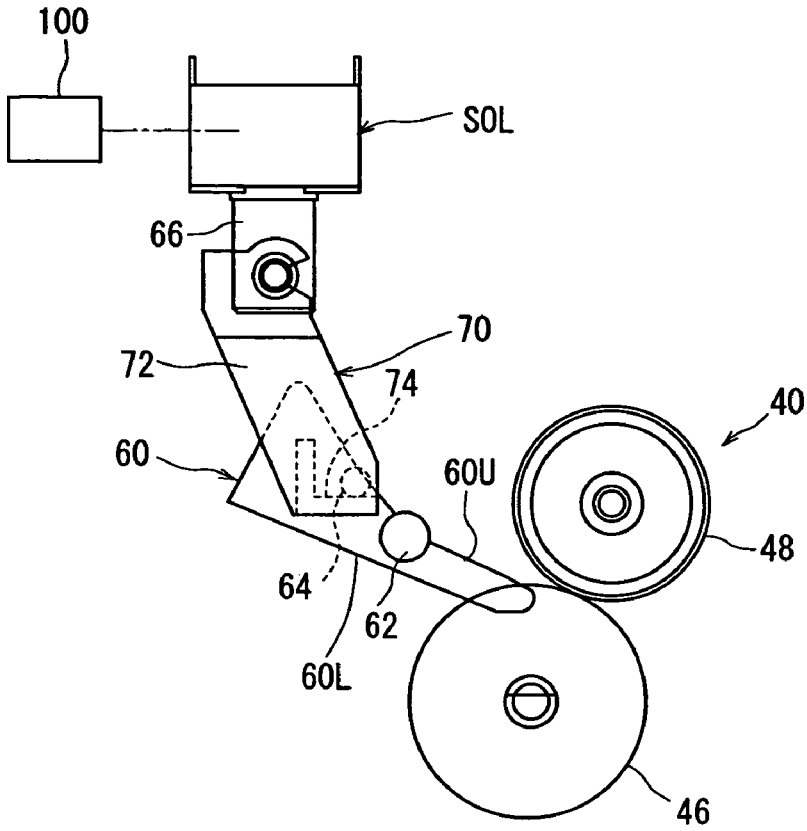
FIG. 7 is a view of constitution illustrating major portions of another embodiment of the paper conveying/branching device of the present invention, and corresponds to FIG. 2.
Figure 9:
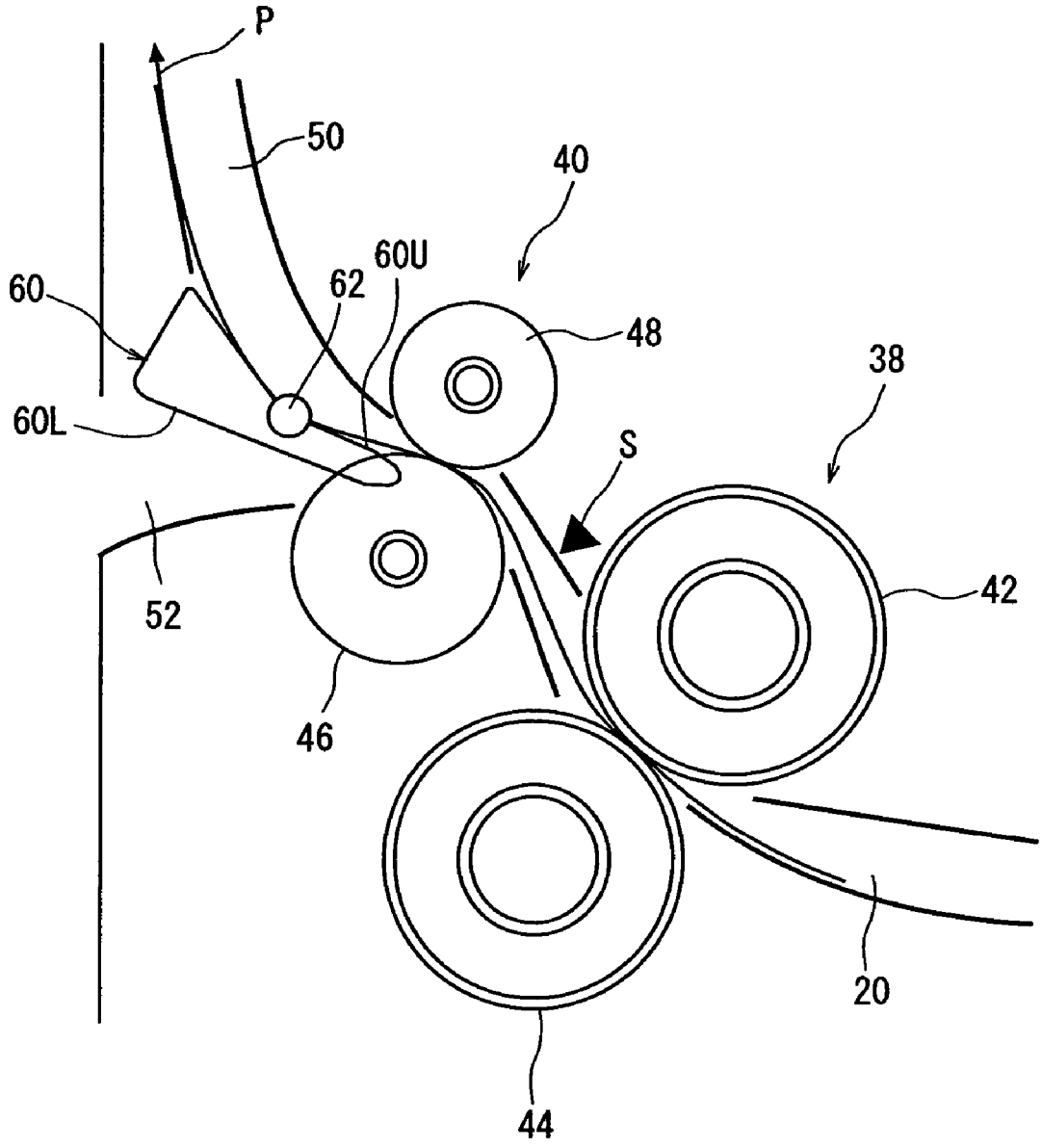
FIG. 9 is a view schematically illustrating a state where the paper is passing through the conveying/branching passage while the conveyer passage change-over guide member is at a first position (first position shown in FIG. 7) represented by a solid line in FIG. 1 in the conveying/branching passage shown in FIG. 1.

Referring to FIGS. 7 to 9, in a state where the conveyer passage change-over guide member 60 is brought to the first position (FIGS. 7 and 9), the controller 100 so operates the solenoid SOL that the displacing member 70 of the solenoid SOL is displaced to the second operation position (FIG. 8) from the first operation position (FIG. 7) after the leading end of the paper P has passed through, or while the leading end of the paper P is passing through, the conveyer passage change-over guide member 60. Namely, in the state where the conveyer passage change-over guide member 60 is brought to the first position (FIG. 7), the controller 100 judges whether the leading end of the paper P has passed through, or is passing through, the conveyer passage change-over guide member 60 after the passage of a predetermined period of time from when the leading end of the paper P was detected by the paper sensor S, and turns the solenoid SOL off. The moving core 66 is lowered, and the displacing member 70 is displaced from the first operation position (FIG. 7) to the second operation position (FIG. 8). The engaging portion 74 of the displacing member 70 is lowered down in a direction to separate away from the to-be-engaged pin 64 of the conveyer passage change-over guide member 60, and the conveyer passage change-over guide member 60 is rotated counterclockwise in FIG. 7 to the second position (FIG. 8) from the first position (FIG. 7) due to its own weight or due to spring means, so that the upstream side in the direction of conveying the paper P (right side in FIG. 7) is raised with respect to the support shafts 62. Here, however, the paper P is passing through the first branched conveyer passage 50 along the upper surface 60U of the conveyer passage change-over guide member 60. Therefore, the conveyer passage change-over guide member 60 is limited by the paper P from rotating. Accordingly, the conveyer passage change-over guide member 60 is positioned in a state that is rotated by a small amount (see FIG. 10).

Figure 10:
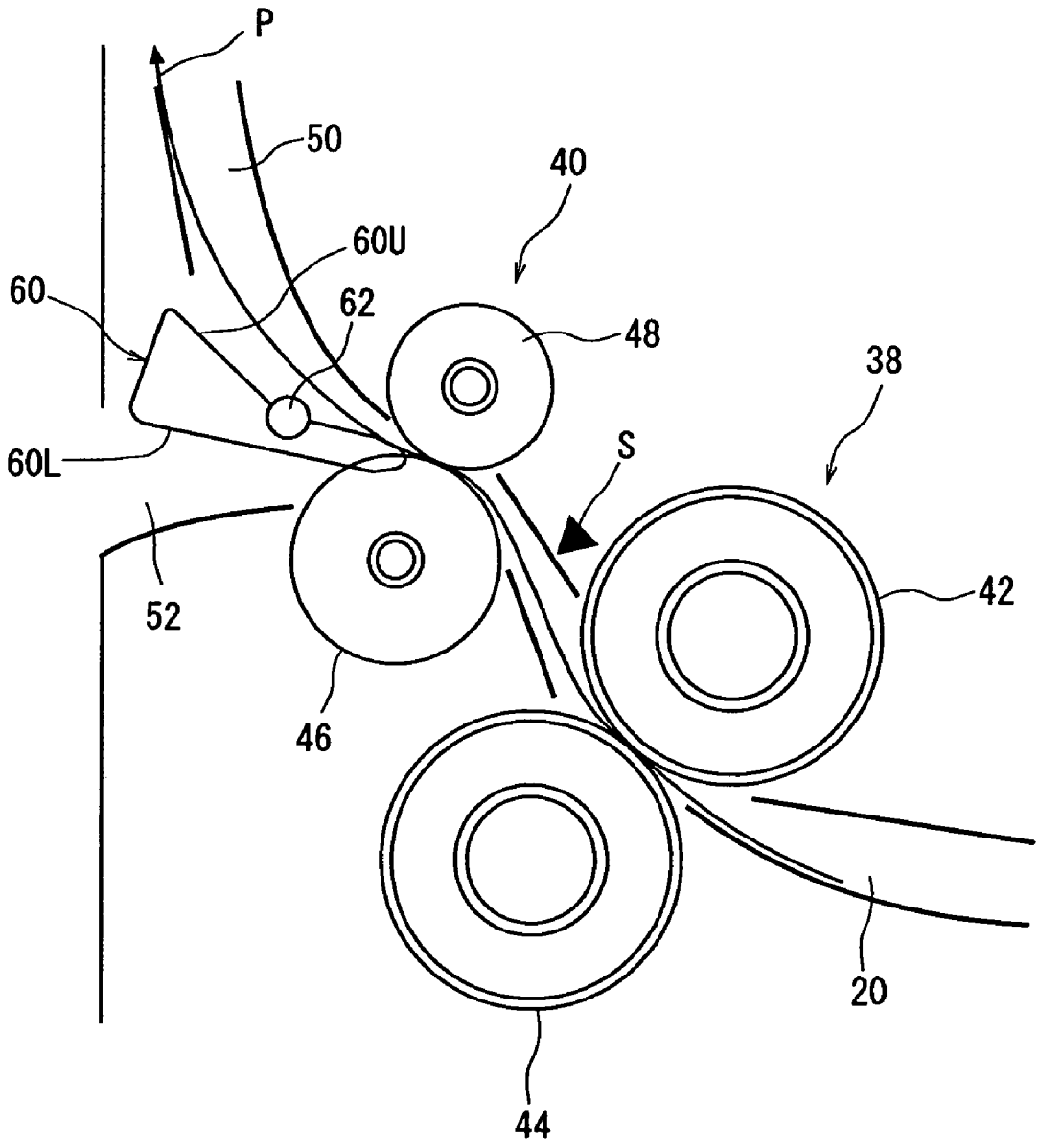
FIG. 10 is a view schematically illustrating a state of the conveyer passage change-over guide member and a state where the paper is passing through the conveying/branching passage when the solenoid is brought to the second operation position shown in FIG. 8 in the state shown in FIG. 9.

As will be easily understood from the comparison of FIG. 9 with FIG. 10, the tilt of the upper surface 60U of the conveyer passage change-over guide member 60 is relaxed by a small amount when the conveyer passage change-over guide member 60 is so rotated by a small amount that the upstream side in the direction of conveyance (right side in FIG. 9) is raised in a state where the paper P is passing through the first branched conveyer passage 50 along the upper surface 60U of the conveyer passage change-over guide member 60 which is at the first position (FIG. 9). Besides, the paper P is slightly pushed up by the upper surface of the upstream end of the conveyer passage change-over guide member 60. Therefore, the paper P is curved mildly (curvature becomes small). This decreases the probability of curling of the paper P that is conveyed through the first branched conveyer passage 50 which is branched from the downstream end of the main conveyer passage 20 for discharging the paper P in a face-down manner.

In the above-mentioned embodiment, the conveyer roller 40 is arranged just upstream of the downstream end of the main conveyer passage 20. According to a further embodiment, the conveyer roller 40 may not be arranged. Moreover, a further roller may be arranged instead of the fixing unit 38.

The invention claimed is:

1. A paper conveying/branching device comprising:

a main conveyer passage having a downstream end;

a first branched conveyer passage branched from the downstream end for discharging paper into a paper discharge tray in a face-down manner;

a second branched conveyer passage branched from the downstream end for discharging the paper into another paper discharge tray in a face-up manner;

a change-over guide member disposed at the downstream end so as to rotate around a support shaft;

an actuator having a displacing member capable of being displaced between a first operation position for changing the change-over guide member to a first position for closing the second branched conveyer passage and communicating the main conveyer passage with the first branched conveyer passage and a second operation position for changing the change-over guide member to a second position for closing the first branched conveyer passage and communicating the main conveyer passage with the second branched conveyer passage;

a paper sensor provided in the main conveyor passage for detecting a leading-end of the paper being conveyed; and a controller for controlling operation of the actuator, wherein upon the change-over guide member being changed to the second position, the paper is so guided as to move along a lower surface of the change-over guide member, upon the displacing member being displaced to the first operation position from the second operation position, the change-over guide member is rotated from the second position to the first position by its own weight or by a spring force of spring means, so that an upstream side in the direction of conveying paper is lowered with respect to the support shaft, and in a state where the change-over guide member is brought to the second position, the controller judges that the leading end of the paper has passed through and the paper is passing through the change-over guide member, or while the leading end of the paper is passing through the change-over guide member, with signals detecting the leading-end of the paper by the paper sensor, the controller operates the actuator to displace the displacing member to the first operation position from the second operation position, so that an upstream side position to the support shaft in a lower surface of the change-over guide member is lowered to be lower than the upstream side position to the support shaft in the lower surface of the change-over guide member which is positioned in the second position, and a downstream side position to the support shaft in the lower surface of the change-over guide member is raised to be higher than the downstream side position to the support shaft in the lower surface of the change-over guide member which is positioned in the second position, so as to reduce curvature of the paper conveyed along the lower surface of the change-over guide member.

2. The paper conveying/branching device according to claim 1, wherein the change-over guide member has a to-be-engaged portion disposed on the upstream of the support shaft in the direction of conveying the paper and is extending outward in the axial direction from the one side thereof in the axial direction, the actuator comprises a solenoid having a moving core that displaces up and down, the displacing member is mounted on the moving core integrally therewith and has an engaging portion positioned on the lower side of the to-be-engaged portion of the change-over guide member, and when the actuator is turned off in a state where the change-over guide member is brought to the second position, the moving core is lowered, the displacing member is displaced to the first operation position from the second operation position, the engaging portion of the displacing member is lowered down in a direction to separate away from the to-be-engaged portion of the change-over guide member, and the change-over guide member is rotated to the first position from the second position due to its own weight or due to spring means.

3. A paper conveying/branching device comprising:

a main conveyer passage having a downstream end;

a first branched conveyer passage branched from the downstream end for discharging paper into a paper discharge tray in a face-down manner;

a second branched conveyer passage branched from the downstream end for discharging the paper into another paper discharge tray in a face-up manner;

a change-over guide member disposed at the downstream end so as to rotate around a support shaft;

an actuator having a displacing member capable of being displaced between a first operation position for changing the change-over guide member to a first position for closing the second branched conveyer passage and communicating the main conveyer passage with the first branched conveyer passage and a second operation position for changing the change-over guide member to a second position for closing the first branched conveyer passage and communicating the main conveyer passage with the second branched conveyer passage;

a paper sensor provided in the main conveyor passage for detecting a leading-end of the paper being conveyed; and a controller for controlling operation of the actuator, wherein upon the change-over guide member being changed to the first position, paper is so guided as to move along an upper surface of the change-over guide member, upon the displacing member being displaced to the second operation position from the first operation position, the change-over guide member is rotated from the first position to the second position by its own weight or by a spring force of spring means, so that an upstream side in the direction of conveying paper is raised with respect to the support shaft, and in a state where the change-over guide member is brought to the first position, the controller judges that the leading end of the paper has passed through and the paper is passing through the change-over guide member, or while the leading end of the paper is passing through the change-over guide member, with signals detecting the leading-end of the paper by the paper sensor, the controller operates the actuator to displace the displacing member to the second operation position from the first operation position, so that an upstream side position to the support shaft in a lower surface of the change-over guide member is raised to be higher than the upstream side position to the support shaft in the lower surface of the change-over guide member which is positioned in the first position, and a downstream side position to the support shaft in the lower surface of the change-over guide member is lowered to be lower than the downstream side position to the support shaft in the lower surface of the change-over guide member which is positioned in the first position so as to reduce curvature of the paper conveyed along the lower surface of the change-over guide member.

4. The paper conveying/branching device according to claim 3, wherein the change-over guide member has a to-be-engaged portion disposed on the downstream of the support shaft in the direction of conveying the paper and is extending outward in the axial direction from the one side thereof in the axial direction, the actuator comprises a solenoid having a moving core that displaces up and down, the displacing member is mounted on the moving core integrally therewith and has an engaging portion positioned on the lower side of the to-be-engaged portion of the change-over guide member, and when the actuator is turned off in a state where the change-over guide member is brought to the first position, the moving core is lowered, the displacing member is displaced to the second operation position from the first operation position, the engaging portion of the displacing member is lowered down in a direction to separate away from the to-be-engaged portion of the change-over guide member, and the change-over guide member is rotated to the second position from the first position due to its own weight or due to spring means.

* * * * *